US005429691A

United States Patent [19]

Hinshaw et al.

[11] Patent Number: 5,429,691

[45] Date of Patent: Jul. 4, 1995

[54] THERMITE COMPOSITIONS FOR USE AS GAS GENERANTS COMPRISING BASIC METAL CARBONATES AND/OR BASIC METAL NITRATES

[75] Inventors: Jerald C. Hinshaw, Farr West; Reed J. Blau, Richmond, both of Utah

[73] Assignee: Thiokol Corporation, Ogden, Utah

[21] Appl. No.: 177,744

[22] Filed: Jan. 5, 1994

Related U.S. Application Data

[63] Continuation-in-part of Ser. No. 103,768, Aug. 10, 1993.

[51] Int. Cl.[6] ..... C06B 31/00

[52] U.S. Cl. ..... 149/45; 149/37; 149/22; 280/728

[58] Field of Search ..... 149/22, 37, 45, 75, 149/108.2, 109.2, 109.4, 35

[56] References Cited

U.S. PATENT DOCUMENTS

| | | | |
|---|---|---|---|
| H464 | 5/1988 | Lee et al. | 102/364 |
| 147,871 | 2/1874 | Shaw . | |
| 2,483,803 | 10/1949 | Bridgman et al. | 73/15.4 |
| 2,981,616 | 4/1961 | Boyer | 52/5 |
| 3,010,815 | 11/1961 | Pierce et al. | 52/5 |
| 3,122,462 | 2/1964 | Kaufman et al. | 149/35 |
| 3,405,068 | 10/1968 | Hiltz | 252/182 |
| 3,450,414 | 6/1969 | Kobori | 280/150 |
| 3,477,955 | 11/1969 | Hiltz | 252/4 |
| 3,674,059 | 7/1972 | Stephenson | 141/4 |
| 3,711,115 | 1/1973 | Lohr | 280/150 AB |
| 3,723,205 | 3/1973 | Scheffee | 149/19 |
| 3,773,351 | 11/1973 | Catanzarite | 280/150 AB |
| 3,773,352 | 11/1973 | Radke | 280/150 AB |
| 3,773,947 | 11/1973 | Boyars et al. | 423/351 |
| 3,775,182 | 8/1973 | Marshall | 252/188.3 |
| 3,779,823 | 12/1973 | Price et al. | 149/19 |
| 3,785,149 | 1/1974 | Timmerman | 60/205 |
| 3,787,074 | 1/1974 | Lewis et al. | 280/150 AB |
| 3,791,302 | 2/1974 | McLeod | 102/70.2 |
| 3,806,461 | 4/1974 | Hendrickson et al. | 252/188.3 R |
| 3,810,655 | 5/1974 | Pracher | 280/150 AB |
| 3,814,694 | 6/1974 | Klager | 252/186 |
| 3,827,715 | 8/1974 | Lynch | 280/150 AB |
| 3,833,029 | 9/1974 | Munn | 141/4 |
| 3,833,432 | 9/1974 | Moy et al. | 149/19.3 |
| 3,837,942 | 9/1974 | Catanzarite | 149/83 |
| 3,862,866 | 1/1975 | Timmerman et al. | 149/21 |
| 3,868,124 | 2/1975 | Johnson | 280/150 AB |
| 3,880,447 | 4/1975 | Thorn et al. | 280/150 AB |
| 3,880,595 | 4/1975 | Timmerman | 23/281 |
| 3,883,373 | 5/1975 | Sidebottom | 149/6 |
| 3,895,098 | 7/1975 | Pietz | 423/351 |
| 3,897,285 | 7/1975 | Hamilton et al. | 149/41 |
| 3,901,747 | 8/1975 | Garner | 149/42 |
| 3,902,934 | 9/1975 | Timmerman | 149/83 |
| 3,910,805 | 10/1975 | Catanzarite | 149/83 |
| 3,912,458 | 10/1975 | Fukuma et al. | 23/281 |
| 3,912,561 | 10/1975 | Doin et al. | 149/35 |
| 3,912,562 | 10/1975 | Garner | 149/41 |
| 3,931,040 | 1/1976 | Breazeale | 252/188.3 R |
| 3,933,543 | 1/1976 | Madden | 149/21 |
| 3,934,984 | 1/1976 | Marlow et al. | 23/281 |
| 3,936,330 | 2/1976 | Dergazarian et al. | 149/35 |
| 3,947,300 | 3/1976 | Passauer et al. | 149/35 |
| 3,950,009 | 4/1976 | Hamilton | 280/150 AB |

(List continued on next page.)

*Primary Examiner*—Donald P. Walsh
*Assistant Examiner*—Anthony R. Chi
*Attorney, Agent, or Firm*—Madson & Metcalf; Ronald L. Lyons

[57] ABSTRACT

A sodium-azide-free gas-generating composition includes an oxidizable inorganic fuel, such as a metal, and an oxidizing agent containing oxygen and a metal. The fuel and the oxidizing agent are selected such that water vapor is produced upon reaction between the inorganic fuel and the oxidizing agent. Although a number of inorganic fuels can be employed, a suitable fuel can be a transition metal, another element such as silicon, boron, aluminum, magnesium, an intermetallic compound, hydrides of these metals and mixtures thereof. Suitable oxidizing agents are selected from basic metal carbonates and basic metal nitrates. The fuel and oxidizing agent are selected such that substantially nontoxic gases are produced such as mixtures of water vapor and either carbon dioxide or nitrogen.

51 Claims, No Drawings

U.S. PATENT DOCUMENTS 3,964,255 6/1976 Catanzarite ..... 60/205
3,971,729 7/1976 Timmerman ..... 252/187 R
3,996,079 12/1976 Divalentin ..... 149/35
4,021,275 5/1977 Kishi et al. ..... 149/35
4,062,708 12/1977 Goetz ..... 149/35
4,114,591 9/1978 Nakagawa ..... 126/263
4,124,515 11/1978 Gruner et al. ..... 252/62
4,128,996 12/1978 Garner et al. ..... 60/205
4,152,891 5/1979 Garner ..... 60/205
4,157,648 6/1979 Brennan et al. ..... 60/205
4,179,327 12/1979 Seldner ..... 156/667
4,200,615 4/1980 Hamilton et al. ..... 422/166
4,203,786 5/1980 Garner ..... 149/19.91
4,203,787 5/1980 Kirchoff et al. ..... 149/35
4,214,438 7/1980 Hamilton et al. ..... 60/205
4,238,253 12/1980 Garner ..... 149/19
4,244,758 1/1981 Garner et al. ..... 149/7
4,246,051 1/1981 Garner et al. ..... 149/7
4,298,412 11/1981 Biddle et al. ..... 149/19.5
4,306,499 12/1981 Holmes ..... 102/202.4
4,339,288 7/1982 Camp ..... 149/8
4,369,079 1/1983 Shaw ..... 149/2
4,370,181 1/1983 Lundstrom et al. ..... 149/2
4,370,930 2/1983 Strasser et al. ..... 102/530
4,376,002 3/1983 Utracki ..... 149/35
4,390,380 6/1983 Camp ..... 149/8
4,407,119 10/1983 Biddle et al. ..... 60/219
4,414,902 11/1983 Strasser et al. ..... 102/531
4,424,086 1/1984 Christopher ..... 149/19.3
4,484,960 11/1984 Rucker ..... 149/22
4,533,416 8/1985 Poole ..... 149/35
4,547,235 10/1985 Schneiter et al. ..... 149/35
4,547,342 10/1985 Adams et al. ..... 422/166
4,578,247 3/1986 Bolieau ..... 422/165
4,590,860 5/1986 Kromrey ..... 102/289
4,604,151 8/1986 Knowlton et al. ..... 149/35
4,664,033 5/1987 Burkdoll et al. ..... 102/275.2
4,690,063 9/1987 Granier et al. ..... 102/530
4,696,705 9/1987 Hamilton ..... 149/21
4,698,107 10/1987 Goetz et al. ..... 149/7
4,699,400 10/1987 Adams et al. ..... 280/731
4,734,141 3/1988 Cartwright et al. ..... 149/35
4,758,287 7/1988 Pietz ..... 149/2
4,798,142 1/1989 Canterberry et al. ..... 102/290
4,806,180 2/1989 Goetz et al. ..... 149/5
4,833,996 5/1989 Hayashi et al. ..... 102/530
4,834,817 5/1989 Zeuner et al. ..... 149/35
4,834,818 5/1989 Kazumi et al. ..... 149/35
4,865,667 9/1989 Zeuner et al. ..... 149/22
4,890,860 1/1990 Schneiter ..... 280/741
4,909,549 3/1990 Poole et al. ..... 280/738
4,919,897 4/1990 Bender et al. ..... 422/165
4,931,111 6/1990 Poole et al. ..... 149/35
4,931,112 6/1990 Wardle et al. ..... 149/88
4,948,439 8/1990 Poole et al. ..... 149/46
4,950,458 8/1990 Cunningham ..... 422/164
4,959,011 9/1990 Nilsson ..... 431/263
4,963,203 10/1990 Halcomb et al. ..... 149/37
4,981,534 1/1991 Scheffe ..... 149/19.91
4,982,664 1/1991 Norton ..... 102/272
4,998,751 3/1991 Paxton et al. ..... 280/741
5,003,887 4/1991 Unterforsthuber ..... 102/531
5,004,586 4/1991 Hayashi et al. ..... 422/164
5,005,486 4/1991 Lenzen ..... 102/531
5,015,309 5/1991 Wardle et al. ..... 149/19.1
5,015,311 5/1991 Ramaswamy ..... 149/42
5,019,192 5/1991 Ramaswamy ..... 149/42
5,019,220 5/1991 Taylor et al. ..... 264/3.4
5,022,674 6/1991 Frantom et al. ..... 280/741
5,024,160 6/1991 Canterberry et al. ..... 102/323
5,031,932 7/1991 Frantom et al. ..... 102/323
5,033,390 7/1991 Minert et al. ..... 102/530
5,043,030 8/1991 Ramaswamy ..... 149/16
5,046,429 9/1991 Swann et al. ..... 102/530
5,052,817 11/1991 Bement et al. ..... 374/8
5,060,973 10/1991 Giovanetti ..... 280/736
5,062,365 11/1991 Canterberry ..... 102/322
5,062,367 11/1991 Hayashi et al. ..... 102/530
5,073,273 12/1991 Gupta et al. ..... 210/760
5,074,940 12/1991 Ochi et al. ..... 149/35
5,089,069 2/1992 Ramaswamy et al. ..... 149/21
5,094,475 3/1992 Olsson et al. ..... 280/741
5,098,597 3/1992 Rothgery et al. ..... 252/182.34
5,100,172 3/1992 Vanvoorhies et al. ..... 280/738
5,100,174 3/1992 Jasken et al. ..... 280/741
5,104,466 4/1992 Allard et al. ..... 149/21
5,141,734 8/1992 Misra et al. ..... 423/580
5,212,343 5/1993 Brupbacher et al. ..... 102/323

THERMITE COMPOSITIONS FOR USE AS GAS GENERANTS COMPRISING BASIC METAL CARBONATES AND/OR BASIC METAL NITRATES

RELATED APPLICATION

This invention is a continuation-in-part of copending U.S. patent application Ser. No. 08/103,768, filed Aug. 10, 1993, titled "Thermite Compositions for Use as Gas Generants," which is incorporated herein by reference.

FIELD OF THE INVENTION

The present invention relates to thermite compositions which are formulated for the purpose of generating a gas. More particularly, the present gas generant compositions comprise a finely divided oxidizable inorganic fuel, such as boron or a metal, mixed with an appropriate oxidizing agent which, when combusted, generates a large quantity of water vapor mixed with either carbon dioxide or nitrogen gas.

BACKGROUND OF THE INVENTION

Gas generating chemical compositions are useful in a number of different contexts. One important use for such compositions is in the operation of "air bags." Air bags are gaining in acceptance to the point that many, if not most, new automobiles are equipped with such devices. Indeed, many new automobiles are equipped with multiple air bags to protect the driver and passengers.

In the context of automobile air bags, sufficient gas must be generated to inflate the device within a fraction of a second. Between the time the car is impacted in an accident, and the time the driver would otherwise be thrust against the steering wheel, the air bag must fully inflate. As a consequence, nearly instantaneous gas generation is required.

There are a number of additional important design criteria that must be satisfied. Automobile manufacturers and others have set forth the required criteria which must be met in detailed specifications. Preparing gas generating compositions that meet these important design criteria is an extremely difficult task. These specifications require that the gas generating composition produce gas at a required rate. The specifications also place strict limits on the generation of toxic or harmful gases or solids. Examples of restricted gases include carbon monoxide, carbon dioxide, $NO_x$, $SO_x$, and hydrogen sulfide. For example, carbon dioxide is limited to about 20 to 30 volume percent of the final gas volume produced.

The gas must be generated at a sufficiently and reasonably low temperature so that an occupant of the car is not burned upon impacting an inflated air bag. If the gas produced is overly hot, there is a possibility that the occupant of the motor vehicle may be burned upon impacting a deployed air bag. Accordingly, it is necessary that the combination of the gas generant and the construction of the air bag isolates automobile occupants from excessive heat. All of this is required while the gas generant maintains an adequate burn rate. In the industry, burn rates in excess of 0.5 inch per second (ips) at 1000 psi, and preferably in the range of from about 1.0 ips to about 1.2 ips at 1000 psi are generally desired.

Another related but important design criteria is that the gas generant composition produces a limited quantity of particulate materials. Particulate materials can interfere with the operation of the supplemental restraint system, present an inhalation hazard, irritate the skin and eyes, or constitute a hazardous solid waste that must be dealt with after the operation of the safety device. In the absence of an acceptable alternative, the production of irritating particulates is one of the undesirable, but tolerated aspects of the currently used sodium azide materials.

In addition to producing limited, if any, quantities of particulates, it is desired that at least the bulk of any such particulates be easily filterable. For instance, it is desirable that the composition produce a filterable, solid slag. If the solid reaction products form a non-fluid material, the solids can be filtered and prevented from escaping into the surrounding environment. This also limits interference with the gas generating apparatus and the spreading of potentially harmful dust in the vicinity of the spent air bag which can cause lung, mucous membrane and eye irritation to vehicle occupants and rescuers.

Both organic and inorganic materials have been proposed as possible gas generants. Such gas generant compositions include oxidizers and fuels which react at sufficiently high rates to produce large quantities of gas in a fraction of a second.

At present, sodium azide is the most widely used and currently accepted gas generating material. Sodium azide nominally meets industry specifications and guidelines. Nevertheless, sodium azide presents a number of persistent problems. Sodium azide is relatively toxic as a starting material, since its toxicity level as measured by oral rat $LD_{50}$ is in the range of 45 mg/kg. Workers who regularly handle sodium azide have experienced various health problems such as severe headaches, shortness of breath, and other symptoms.

In addition, no matter what auxiliary oxidizer is employed, the combustion products from a sodium azide gas generant include caustic reaction products such as sodium oxide, or sodium hydroxide. Molybdenum disulfide or sulfur have been used as oxidizers for sodium azide. However, use of such oxidizers results in toxic products such as hydrogen sulfide gas and corrosive materials such as sodium oxide and sodium sulfide. Rescue workers and automobile occupants have complained about both the hydrogen sulfide gas and the corrosive powder produced by the operation of sodium azide-based gas generants.

Increasing problems are also anticipated in relation to disposal of unused gas-inflated supplemental restraint systems, e.g. automobile air bags, in demolished cars. The sodium azide remaining in such supplemental restraint systems can leach out of the demolished car to become a water pollutant or toxic waste. Indeed, some have expressed concern that sodium azide might form explosive heavy metal azides or hydrazoic acid when contacted with battery acids following disposal.

Sodium azide-based gas generants are most commonly used for air bag inflation, but with the significant disadvantages of such compositions many alternative gas generant compositions have been proposed to replace sodium azide. Most of the proposed sodium azide replacements, however, fail to deal adequately with all of the criteria set forth above.

One group of chemicals that has received attention as a possible replacement for sodium azide includes tetrazoles and triazoles. These materials are generally coupled with conventional oxidizers such as $KNO_3$ and $Sr(NO_3)_2$. Some of the tetrazoles and triazoles that have been specifically mentioned include 5-aminotetrazole, 3-amino-1,2,4-triazole, 1,2,4-triazole, 1H-tetrazole, bitetrazole and several others. However, because of poor ballistic properties and high gas temperatures, none of these materials has yet gained general acceptance as a sodium azide replacement.

It will be appreciated, therefore, that there are a number of important criteria for selecting gas generating compositions for use in automobile supplemental restraint systems. For example, it is important to select starting materials that are not toxic. At the same time, the combustion products must not be toxic or harmful. In this regard, industry standards limit the allowable amounts of various gases produced by the operation of supplemental restraint systems.

It would, therefore, be a significant advance to provide compositions capable of generating large quantities of gas that would overcome the problems identified in the existing art. It would be a further advance to provide a gas generating composition which is based on substantially nontoxic starting materials and which produces substantially nontoxic reaction products. It would be another advance in the art to provide a gas generating composition which produces very limited amounts of toxic or irritating particulate debris and limited undesirable gaseous products. It would also be an advance to provide a gas generating composition which forms a readily filterable solid slag upon reaction.

Such compositions and methods for their use are disclosed and claimed herein.

SUMMARY AND OBJECTS OF THE INVENTION

The present invention relates to a novel gas generating composition which is loosely based on a "thermite"-type composition. The present composition comprises a mixture of finely divided inorganic fuel and an oxidizing agent such as a basic metal carbonate or a basic metal nitrate, provided that the inorganic fuel and the oxidizing agent are selected such that substantially nontoxic gaseous reaction products are produced when the composition is combusted, such as water vapor and either carbon dioxide or nitrogen gas.

The combustion reaction involves an oxidation-reduction reaction between the fuel and oxidizing agent. Under the exothermic conditions produced by the reaction, the water precursors are converted to water vapor, the carbonate, if present, is converted to carbon dioxide, and the nitrate, if present, is converted to nitrogen. These substantially nontoxic gaseous reaction products are then available for use in deploying supplemental safety restraint devices such as inflating automobile air bags and the like.

It will be appreciated from the foregoing that the compositions of the present invention can generate large quantities of gas while avoiding some of the significant problems identified in the existing art. The gas generating compositions of the present invention are based on substantially nontoxic starting materials, and produce substantially nontoxic reaction products.

These compositions produce only limited, if any, undesirable gaseous products. In addition, upon reaction, the gas generating compositions of the present invention produce only a limited amount, if any, of toxic or irritating particulate debris while yielding a filterable solid slag.

These compositions combust rapidly and reproducibly to generate the substantially nontoxic gaseous reaction products described above.

DETAILED DESCRIPTION OF THE INVENTION

The compositions of the present invention include an oxidizable inorganic fuel, such as an oxidizable metal or another element, in a fuel-effective amount and an oxidizing agent, in particular, a basic metal carbonate, a basic metal nitrate, or mixtures thereof, in an oxidizer-effective amount. As used herein, a basic metal carbonate includes metal carbonate hydroxides, metal carbonate oxides, and hydrates thereof. As used herein, a basic metal nitrate includes metal nitrate hydroxides, metal nitrate oxides, and hydrates thereof. The fuel and the oxidizing agent combination is selected with the proviso that substantially nontoxic gaseous reaction products, such as mixtures of water vapor and either carbon dioxide or nitrogen, are the major gaseous products produced upon reaction between the fuel and the oxidizing agent and that essentially no, if any, hazardous gaseous reaction products are produced by that reaction. The fuel and the oxidizer are selected so that the combination of oxidizer and fuel exhibits reasonable thermal compatibility and chemical stability, that is, the combination of fuel and oxidizer does not begin reacting below about 225° F. A fuel or oxidizer, or the combustion products therefrom, which would be highly toxic is not preferred.

In the operation of a supplemental restraint device or related safety device according to the present invention, other gases, if any, are produced in concentrations that are low relative to the desired gaseous combustion product, carbon dioxide, mixtures of carbon dioxide and water vapor, or mixtures of nitrogen and water vapor.

Thermite is generally defined as a composition consisting of a mixture of finely divided oxidizable inorganic fuel, conventionally aluminum or an oxidizable metal, and a corresponding oxidizing agent. Thermite compositions are conventionally used and designed to generate large quantities of intense heat without generating significant quantities of gas. In that context, the most commonly used thermite compositions are based on finely divided aluminum metal and iron oxide.

One of the distinguishing characteristics of most conventional thermite compositions is that they are designed to produce little or no gaseous reaction products. While having some semblance to conventional thermite compositions, the compositions of the present invention are unique in that mixtures of water vapor and either carbon dioxide or nitrogen are the desired major gaseous reaction products and that such gaseous products are produced in a sufficient amount and volume to be used to inflate an automobile air bag, or for a similar type of function generally performed by gas generating compositions.

The oxidizable inorganic fuel contains, for example, at least one oxidizable species selected from elements from among Groups 2, 4, 5, 6, 7, 8, 12, 13 and 14 as listed in the Periodic Table of the Elements according to the IUPAC format (*CRC Handbook of Chemistry and Physics*, (72nd Ed. 1991)). The oxidizable inorganic fuel can comprise, for instance, at least one transition metal, such as iron, manganese, molybdenum, niobium, tantalum, titanium, tungsten, zinc, or zirconium. The fuel can comprise another element, such as, for instance, aluminum, boron, magnesium, silicon or tin. A preferred inorganic fuel is elemental boron.

The fuel can also comprise an intermetallic compound or an alloy of at least two elements selected from among Groups 2, 4, 5, 12, 13, and 14 of the Periodic Table. Illustrative of these intermetallic compounds and alloys are, for example, $Al_3Mg_2$, $Al_{38}Si_5$, $Al_2Zr_3$, $B_{12}Zr$, $MgB_4$, $Mg_2Nb$, MgZn, $Nb_3Al$, $Nb_3Sn$, $Ta_3Zr_2$, TiAl, $TiB_2$, $Ti_{18}Nb_5$ and ZrTi. The inorganic fuel can also comprise a hydride, carbide, or nitride of a transition metal or main group element. Exemplary hydrides include, among others, $TiH_2$, $ZrH_2$, $KBH_4$, $NaBH_4$, and $Cs_2B_{12}H_{12}$. Exemplary carbides include, among others, ZrC, TiC, MoC, and $B_4C$. Exemplary nitrides include, among others, ZrN, TiN, $Mo_2N$, BN, $Si_3N_4$, and $P_3N_5$. Mixtures of these oxidizable inorganic fuels are also useful herein. When a metal carbide, nitride, or hydride is the fuel, then the fuel may also assist in generating the desired gaseous reaction products. For instance, the metal carbides may produce carbon dioxide in addition to that produced by basic metal carbonate oxidizing agents. Similarly, the metal nitrides may produce nitrogen in addition to that produced by the basic metal nitrate oxidizing agents. In some cases, supplemental oxidizers may be necessary to completely oxidize the fuel or enhance the burn rate.

Both the oxidizable inorganic fuel and the oxidizer are incorporated into the composition in the form of a finely divided powder. Particle sizes typically range from about 0.001 $\mu$ to about 400 $\mu$, although the particle sizes preferably range from about 0.1 $\mu$ to about 50 $\mu$. The composition is insertable into a gas generating device, such as a conventional supplemental safety restraint system, in the form of pellets or tablets. Alternatively, the composition is insertable in such devices in the form of a multi-perforated, high surface area grain or other solid form which allows rapid and reproducible generation of gas upon ignition.

A metal-containing oxidizing agent is paired with the fuel. In the present context, a metal-containing oxidizing agent has the following characteristics:

(a) It is a basic metal carbonate, basic metal nitrate, or hydrate thereof.

(b) One or more of the metals contained therein can act as an oxidizing agent for the inorganic fuel found in the gas generant formulation.

Given the foregoing, the class of suitable inorganic oxidizers possessing the desired traits includes basic metal carbonates such as metal carbonate hydroxides, metal carbonate oxides, metal carbonate hydroxide oxides, and hydrates and mixtures thereof and basic metal nitrates such as metal hydroxide nitrates, metal nitrate oxides, and hydrates and mixtures thereof wherein the metal species therein can be at least one species selected from elements from among Groups 5, 6, 7, 8, 9, 10, 11, 12, 14 and 15 as listed in the Periodic Table of the Elements according to the IUPAC format (*CRC Handbook of Chemistry and Physics*, (72nd Ed. 1991)).

Table 1, below, lists examples of typical basic metal carbonates capable of reacting with a suitable fuel to produce mixtures of carbon dioxide and water vapor:

TABLE 1

| Basic Metal Carbonates |
|---|
| $Cu(CO_3)_{1-x}.Cu(OH)_{2x}$, e.g., $CuCO_3.Cu(OH)_2$ (malachite) |
| $Co(CO_3)_{1-x}(OH)_{2x}$, e.g., $2Co(CO_3).3Co(OH)_2.H_2O$ |
| $Co_xFe_y(CO_3)_2(OH)_2$, e.g., $Co_{0.69}Fe_{0.34}(CO_3)_{0.2}(OH)_2$ |
| $Na_3[Co(CO_3)_3].3H_2O$ |
| $Zn(CO_3)_{1-x}(OH)_{2x}$, e.g., $Zn_2(CO_3)(OH)_2$ |
| $Bi_AMg_B(CO_3)_C(OH)_D$, e.g., $Bi_2Mg(CO_3)_2(OH)_4$ |
| $Fe(CO_3)_{1-x}(OH)_{3x}$, e.g., $Fe(CO_3)_{0.12}(OH)_{2.76}$ |
| $Cu_{2-x}Zn_x(CO_3)_{1-y}(OH)_{2y}$, e.g., $Cu_{1.54}Zn_{0.46}CO_3(OH)_2$ |
| $Co_yCu_{2-y}(CO_3)_{1-x}(OH)_{2x}$, e.g., $Co_{0.49}Cu_{0.51}(CO_3)_{0.43}(OH)_{1.1}$ |
| $Ti_ABi_B(CO_3)_x(OH)_y(O)_z(H_2O)_c$, e.g., $Ti_3Bi_4(CO_3)_2(OH)_2O_9(H_2O)_2(BiO)_2CO_3$ |

Table 2, below, lists examples of typical basic metal nitrates capable of reacting with a suitable fuel to produce mixtures of nitrogen and water vapor:

TABLE 1

| Basic Metal Carbonates |
|---|
| $Cu(CO_3)_{1-x}.Cu(OH)_{2x}$, e.g., $CuCO_3.Cu(OH)_2$ (malachite) |
| $Co(CO_3)_{1-x}(OH)_{2x}$, e.g., $2Co(CO_3).3Co(OH)_2.H_2O$ |
| $Co_xFe_y(CO_3)_2(OH)_2$, e.g., $Co_{0.69}Fe_{0.34}(CO_3)_{0.2}(OH)_2$ |
| $Na_3[Co(CO_3)_3].3H_2O$ |
| $Zn(CO_3)_{1-x}(OH)_{2x}$, e.g., $Zn_2(CO_3)(OH)_2$ |
| $Bi_AMg_B(CO_3)_C(OH)_D$, e.g., $Bi_2Mg(CO_3)_2(OH)_4$ |
| $Fe(CO_3)_{1-x}(OH)_{3x}$, e.g., $Fe(CO_3)_{0.12}(OH)_{2.76}$ |
| $Cu_{2-x}Zn_x(CO_3)_{1-y}(OH)_{2y}$, e.g., $Cu_{1.54}Zn_{0.46}CO_3(OH)_2$ |
| $Co_yCu_{2-y}(CO_3)_{1-x}(OH)_{2x}$, e.g., $Co_{0.49}Cu_{0.51}(CO_3)_{0.43}(OH)_{1.1}$ |
| $Ti_ABi_B(CO_3)_x(OH)_y(O)_z(H_2O)_c$, e.g., $Ti_3Bi_4(CO_3)_2(OH)_2O_9(H_2O)_2(BiO)_2CO_3$ |

Table 2, below, lists examples of typical basic metal nitrates capable of reacting with a suitable fuel to produce mixtures of nitrogen and water vapor:

TABLE 2

| Basic Metal Nitrates |
|---|
| $Cu_2(OH)_3NO_3$ |
| $Co_2(OH)_3NO_3$ |
| $Cu_xCo_{2-x}(OH)_3NO_3$, e.g., $CuCo(OH)_3NO_3$ |
| $Zn_2(OH)_3NO_3$ |
| $Mn(OH)_3NO_3$ |
| $Fe(NO_3)_n(OH)_{3-n}$, e.g., $Fe_4(OH)_{11}NO_3.2H_2O$ |
| $Mo(NO_3)_2O_2$ |
| $BiONO_3.H_2O$ |
| $Ce(OH)(NO_3)_3.3H_2O$ |

In certain instances it will also be desirable to use mixtures of such oxidizing agents in order to enhance ballistic properties or maximize filterability of the slag formed from combustion of the composition. A preferred oxidizing agent is $CuCO_3.Cu(OH)_2$, commonly known as the natural mineral malachite.

In addition, small amounts, such as up to about 10 wt. %, of supplemental oxidizing agents, such as metal oxides, peroxides, nitrates, nitrites, chlorates and perchlorates, can, if desired, be combined with the inorganic oxidizer.

The gas generant compositions of the present invention comprise a fuel-effective amount of fuel and an oxidizer-effective amount of at least one oxidizing agent. The present composition, in general, contains about 2 wt. % to about 50 wt. % fuel and from about 50 wt. % to about 98 wt. % oxidizing agent, and preferably from about 5 wt. % to about 40 wt. % fuel and from about 60 wt. % to about 95 wt. % oxidizing agent. These weight percentages are such that at least one oxidizing agent is present in an amount from about 0.5 to about 3 times the stoichiometric amount necessary to completely oxidize the fuel present. More preferably, the oxidizing agent is present from about 0.8 to about 2 times the stoichiometric amount of oxidizer necessary to completely oxidize the fuel present.

Preferred embodiments where only nitrogen and water vapor are formed will contain less than, e.g., about 0.9 times, the stoichiometric amount of oxidizer necessary to completely oxidize the fuel present in order to minimize $NO_x$ formation. Likewise, preferred embodiments where only carbon dioxide and water vapor are formed will contain more than, e.g., about 1.2 times, the stoichiometric amount of oxidizer necessary to completely oxidize the fuel present in order to minimize carbon monoxide formation. Thus, the above preferred embodiments have added advantages over gas generant formulations where both nitrogen and carbon are present. In such formulations, attempts to minimize $NO_x$ formation by changing the oxidizer/fuel ratio will promote carbon monoxide formation and vice versa.

Small quantities of other additives may also be included within the compositions if desired. Such additives are well known in the explosive, propellant, and gas generant arts. Such materials are conventionally added in order to modify the characteristics of the gas generating composition. Such materials include ballistic or burn rate modifiers, ignition aids, coolants, release agents or dry lubricants, binders for granulation or pellet crush strength, slag enhancers, anticaking agents, etc. An additive often serves multiple functions. The additives may also produce gaseous reaction products to aid in the overall gas generation of the gas generant composition.

Ignition aids/burn rate modifiers include metal oxides, nitrates and other compounds such as, for instance, $Fe_2O_3$, $K_2B_{12}H_{12}.H_2O$, $BiO(NO_3)$, $Co_2O_3$, $CoFe_2O_4$, $CuMoO_4$, $Bi_2MoO_6$, $MnO_2$, $Mg(NO_3)_2$, $Fe(NO_3)_3$, $Co(NO_3)_2$, and $NH_4NO_3$. Coolants include magnesium hydroxide, boric acid, aluminum hydroxide, and silicotungstic acid. Cupric oxalate, $CuC_2O_4$, not only functions as a coolant, but also is capable of generating carbon dioxide. Coolants such as aluminum hydroxide and silicotungstic acid can also function as slag enhancers. Small amounts of polymeric binders, such as polyethylene glycol or polypropylene carbonate can, if desired, be added for mechanical properties reasons or to provide enhanced crush strength. Examples of dry lubricants include $MoS_2$, graphite, graphitic-boron nitride, calcium stearate and powdered polyethylene glycol (Avg. MW 8000).

The solid combustion products of most of the additives mentioned above will enhance the filterability of the slag produced upon combustion of a gas generant formulation. For example, a preferred embodiment of the invention comprises a combination of 76.23 wt. % $Cu_2(OH)_3NO_3$ as the oxidizer and 23.77 wt. % titanium hydride as the fuel. The flame temperature is predicted to be 2927° K. The slag therefrom is copper metal (1) and titanium dioxide (1). Commercially available $Al(OH)_3.0.4H_2O$ can be added to the formulation as a coolant/binder. This additive will also enhance the filterability of the slag. For example, a formulation containing 60.0 weight % $Cu_2(OH)_3NO_3$, 18.71 weight % $TiH_2$, 21.29 weight % $Al(OH)_3.0.4H_2O$ decreases the flame temperature to 2172° K. This formulation produces 25.5% gas by weight. Aluminum oxide is formed as a solid at this temperature (12.74 wt. %) whereas $TiO_2$ (29.95 wt. %) is only 42° K. above its melting point. The molten copper slag (32%) would likely be entrapped by the viscous mixture of $TiO_2/Al_2O_3$ slag enhancing overall filterability. In addition the overall volume corrected gas yield relative to azide generants increases from 1.09 to 1.14 upon addition of $Al(OH)_3$ to the formulation.

Illustrative examples of reactions involving compositions within the scope of the present invention are set forth in Table 3.

TABLE 3

| Reaction | Theoretical Gas Yield | Flame Temp. (°K) |
|---|---|---|
| $4B+3Cu(OH)_2CuCO_3 \rightarrow 2B_2O_3+6Cu+3H_2O+3CO_2$ | 0.881 | 1923 |
| $6B+2Cu_2(OH)_3NO_3 \rightarrow 3B_2O_3+4Cu+3H_2O+N_2$ | 0.659 | 2848 |
| $ZrC+2Cu(OH)_2CuCO_3 \rightarrow ZrO_2+2Cu+2H_2O+3CO_2$ | 1.09 | 1358 |
| $3TiH_2+2Cu_2(OH)_3NO_3 \rightarrow 3TiO_2+4Cu+6H_2O+N_2$ | 1.091 | 2927 |
| $3TiH_2+2Fe_4(OH)_{11}NO_3 \rightarrow 3TiO_2+8FeO+14H_2O+N_2$ | 0.991 | 1493 |
| $3TiH_2+2Cu_2(OH)_3NO_3+2Al(OH)_3 \rightarrow 3TiO_2+4Cu+9H_2O+9N_2$ | 1.147 | 2172 |
| $8TiH_2+6BiONO_3 \rightarrow 8TiO_2+6Bi+8H_2O+3N_2$ | 0.839 | 3219 |
| $18TiN+8Cu_2(OH)_3NO_3 \rightarrow 18TiO_2+16Cu+12H_2O+9N_2$ | 0.902 | 2487 |
| $9Ti+4Cu_2(OH)_3NO_3 \rightarrow 9TiO_2+8Cu+6H_2O+2N_2$ | 0.597 | 3461 |
| $3TiH_2+2Co_2(OH)_3NO_3 \rightarrow 3TiO_2+4Co+6H_2O+N_2$ | 1.180 | 2513 |

Theoretical gas yields (gas volume and quantity) for a composition according to the present invention are comparable to those achieved by a conventional sodium azide-based gas generant composition. Theoretical gas yield is a normalized relation to a unit volume of azide-based gas generant. The theoretical gas yield for a typical sodium azide-based gas generant (68 wt. % $NaN_3$; 30 wt. % of $MoS_2$; 2 wt. % of S) is about 0.85 g gas/cc $NaN_3$ generant.

The theoretical flame temperatures of the reaction between the fuel and the oxidizing agent are in the range of from about 500° K. to about 3500° K., with the more preferred range being from about 1500° K. to about 3000° K. This is a manageable range for application in the field of automobile air bags and can be adjusted to form non-liquid (e.g., solid) easily filterable slag.

With the reaction characteristics, the compositions and methods of the present invention can produce a sufficient volume and quantity of gas to inflate a supplemental safety restraint device, such as an automobile air bag, at a manageable temperature. The reaction of the compositions within the scope of the invention produce significant quantities of gaseous mixture of water vapor and either carbon dioxide or nitrogen in a very short period of time. At the same time, the reaction substantially avoids the production of unwanted gases and particulate materials, although minor amounts of other gases may be produced. The igniter formulation may also produce small amounts of other gases.

The present gas generant compositions can be formulated to produce an integral solid slag to limit substantially the particulate material produced. This minimizes the production of solid particulate debris outside the combustion chamber. Thus, it is possible to substantially avoid the production of a caustic powder, such as sodium oxide/hydroxide or sodium sulfide, commonly produced by conventional sodium azide formulations.

The compositions of the present invention are ignited with conventional igniters. Igniters using materials such as boron/potassium nitrate are usable with the compositions of the present invention. Thus, it is possible to substitute the compositions of the present invention in state-of-the-art gas generant applications.

The gas generating compositions of the present invention are readily adapted for use with conventional hybrid air bag inflator technology. Hybrid inflator technology is based on heating a stored inert gas (argon or helium) to a desired temperature by burning a small amount of propellant. Hybrid inflators do not require cooling filters used with pyrotechnic inflators to cool combustion gases, because hybrid inflators are able to provide a lower temperature gas. The gas discharge temperature can be selectively changed by adjusting the ratio of inert gas weight to propellant weight. The higher the gas weight to propellant weight ratio, the cooler the gas discharge temperature.

A hybrid gas generating system comprises a pressure tank having a rupturable opening, a pre-determined amount of inert gas disposed within that pressure tank; a gas generating device for producing hot combustion gases and having means for rupturing the rupturable opening; and means for igniting the gas generating composition. The tank has a rupturable opening which can be broken by a piston when the gas generating device is ignited. The gas generating device is configured and positioned relative to the pressure tank so that hot combustion gases are mixed with and heat the inert gas. Suitable inert gases include, among others, argon, and helium and mixtures thereof. The mixed and heated gases exit the pressure tank through the opening and ultimately exit the hybrid inflator and deploy an inflatable bag or balloon, such as an automobile air bag. The gas generating device contains a gas generating composition according to the present invention which comprises an oxidizable inorganic fuel and an oxidizing agent selected from basic metal carbonates and basic metal nitrates. The oxidizable inorganic fuel and oxidizing agent being selected so that substantially nontoxic gases are produced such as mixtures of water vapor and either carbon dioxide or nitrogen.

The high heat capacity of water vapor produced is an added advantage for its use as a heating gas in a hybrid gas generating system. Thus, less water vapor, and consequently, less generant is needed to heat a given quantity of inert gas to a given temperature. A preferred embodiment of the invention yields hot (2900° K.) metallic copper as a combustion product. The high conductivity of the copper allows a rapid transfer of heat to the cooler inert gas causing a further improvement in the efficiency of the hybrid gas generating system.

Hybrid gas generating devices for supplemental safety restraint application are described in Frantom, Hybrid Airbag Inflator Technology, *Airbag Int'l Symposium on Sophisticated Car Occupant Safety Systems*, (Weinbrenner-Saal, Germany, Nov. 2–3, 1992).

An automobile air bag system can comprise a collapsed, inflatable air bag, a gas generating device connected to the air bag for inflating the air bag, and means for igniting the gas generating composition. The gas generating device contains a gas generating composition comprising an oxidizable inorganic fuel and an oxidizing agent selected from basic metal carbonates and basic metal nitrates with the oxidizable inorganic fuel and oxidizing agent being selected so that mixtures of water vapor and either carbon dioxide or nitrogen are produced upon reaction between the inorganic fuel and the oxidizing agent.

EXAMPLES

The present invention is further described in the following nonlimiting examples. Unless otherwise stated, the compositions are expressed in weight percent.

Example 1

A mixture of 93.21% $Cu(OH)_2CuCO_3$ and 6.79% boron (containing 89% active boron) was prepared in a water slurry as a hand mix. The formulation was dried in vacuo at 165° F. Three 4-gram quantities of the dried powder were pressed into 0.5-inch diameter pellets at 9000-lb gauge pressure in a Carver Model M press. The pellets were equilibrated individually at 1000 psi for 10 min and ignited yielding a burn rate of 0.405 ips. The slag consisted of a solid mass of copper metal, copper(I) oxide, and boron oxide. According to theoretical calculations, the gas yield was approximately 50% $CO_2$ and 50% $H_2O$ by volume.

Example 2

Theoretical calculations were conducted on the reaction of $TiH_2$ and $Cu_2(OH)_3NO_3$ as listed in Table 3 to evaluate its use in a hybrid gas generator. If this formulation is allowed to undergo combustion in the presence of 3.15 times its weight in argon gas, the flame temperature decreases from 2927° K. to 1606° K., assuming 100% efficient heat transfer. The output gases consist of 87.6% by volume argon, 10.6% by volume water vapor, and 1.8% by volume nitrogen.

From the foregoing, it will be appreciated that the present invention provides compositions capable of generating large quantities of gas which are based on substantially nontoxic starting materials and which produce substantially nontoxic reaction products. The gas generant compositions of the present invention also produce very limited amounts of toxic or irritating particulate debris and limited undesirable gaseous products. In addition, the present invention provides gas generating compositions which form a readily filterable solid slag upon reaction.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A solid gas-generating composition comprising an oxidizable inorganic fuel and an oxidizing agent, wherein said oxidizing agent comprises at least one member selected from the group consisting of a basic metal carbonate and a basic metal nitrate, and wherein a mixture of water vapor and either carbon dioxide or nitrogen are the major gaseous reaction products generated by said gas generating composition.

2. A solid gas-generating composition according to claim 1, comprising from about 2% to about 50% fuel and from about 50% to about 98% oxidizing agent.

3. A solid gas-generating composition according to claim 1, comprising from about 5% to about 40% fuel and from about 60% to about 95% oxidizing agent.

4. A solid gas-generating composition according to claim 1, wherein the oxidizing agent is present in an amount from about 0.5 to about 3 times the stoichiometric amount of oxidizing agent necessary to completely oxidize the fuel present.

5. A solid gas-generating composition according to claim 1, wherein the oxidizing agent is present in an amount from about 0.8 to about 2 times the stoichiometric amount of oxidizing agent necessary to completely oxidize the fuel present.

6. A solid gas-generating composition according to claim 1, wherein the oxidizable inorganic fuel is a metal.

7. A solid gas-generating composition according to claim 1, wherein the oxidizable inorganic fuel is a transition metal.

8. A solid gas-generating composition according to claim 1, wherein the oxidizable inorganic fuel is selected from the group consisting of boron, silicon and tin.

9. A solid gas-generating composition according to claim 1, wherein the oxidizable inorganic fuel is selected from the group consisting of aluminum and magnesium.

10. A solid gas-generating composition according to claim 1, wherein the oxidizable inorganic fuel is an intermetallic compound or an alloy of at least two elements selected from among Groups 2, 4, 5, 12, 13, and 14 of the Periodic Table.

11. A solid gas-generating composition according to claim 1, wherein the oxidizable inorganic fuel is a transition metal hydride.

12. A solid gas-generating composition according to claim 1, wherein the oxidizable inorganic fuel contains at least one member selected from one group consisting of Al, B, Fe, Mg, Mn, Mo, Nb, Si, Sn, Ta, Ti, W, Zn, and Zr.

13. A solid gas-generating composition according to claim 1, wherein the oxidizing agent is a basic metal carbonate selected from metal carbonate hydroxides, metal carbonate oxides, and hydrates and mixtures thereof.

14. A solid gas-generating composition according to claim 1, wherein the oxidizing agent is a basic metal carbonate selected from the group of consisting of $CuCO_3.Cu(OH)_2$, $2Co(CO_3).3Co(OH)_2.H_2O$, $Co_{0.69}Fe_{0.34}(CO_3)_{0.2}(OH)_2$, $Na_3[Co(CO_3)_3].3H_2O$, $Zn_2(CO_3)(OH)_2$, $Bi_2Mg(CO_3)_2(OH)_4$, $Fe(CO_3)_{0.12}(OH)_{2.76}$, $Cu_{1.54}Zn_{0.46}CO_3(OH)_2$, $Co_{0.49}Cu_{0.51}(CO_3)_{0.43}(OH)_{1.1}$, $Ti_3Bi_4(CO_3)_2(OH)_2O_9(H_2O)_2$, and $(BiO)_2CO_3$.

15. A solid gas-generating composition according to claim 1, wherein the oxidizing agent is a basic metal nitrate selected from metal nitrate hydroxides, metal nitrate oxides, and hydrates and mixtures thereof.

16. A solid gas-generating composition according to claim 1, wherein the oxidizing agent is a basic metal nitrate selected from the group consisting of $Cu_2(OH)_3NO_3$, $Co_2(OH)_3NO_3$, $CuCo(OH)_3NO_3$, $Zn_2(OH)_3NO_3$, $Mn(OH)_2NO_3$, $Fe_4(OH)_{11}NO_3.2H_2O$, $Mo(NO_3)_2O_2$, $BiONO_3.H_2O$, and $Ce(OH)(NO_3)_3.3H_2O$.

17. A solid gas-generating composition according to claim 1, wherein the oxidizable inorganic fuel and the oxidizer are in the form of a finely divided powder.

18. A solid gas-generating composition according to claim 17, wherein the particle size range of the powder is from about 0.001 $\mu$ to about 400 $\mu$.

19. An automobile air bag system comprising:

a collapsed, inflatable air bag;

a gas-generating device connected to the air bag for inflating said air bag, said gas-generating device containing a gas-generating composition comprising an oxidizable inorganic fuel and at least one oxidizing agent selected from the group consisting of a basic metal carbonate and a basic metal nitrate, said oxidizable inorganic fuel and said oxidizing agent being selected such that a mixture of water vapor and either carbon dioxide or nitrogen are the major gaseous reaction products generated by said gas generating composition; and means for igniting said gas-generating composition.

20. An automobile air bag system according to claim 19, wherein said gas-generating composition comprises from about 2% to about 50% oxidizable inorganic fuel and from about 50% to about 98% oxidizing agent.

21. An automobile air bag system according to claim 19, wherein said gas-generating composition comprises from about 60% to about 95% oxidizing agent.

22. An automobile air bag system according to claim 19, wherein the oxidizing agent of said gas-generating composition is present in an amount from about 0.5 to about 3 times the stoichiometric amount of oxidizing agent necessary to completely oxidize the fuel present.

23. An automobile air bag system according to claim 19, wherein the oxidizing agent of said gas-generating composition is present in an amount from about 0.8 to about 2 times the stoichiometric amount of oxidizer necessary to completely oxidize the fuel present.

24. An automobile air bag system according to claim 19, wherein said oxidizable inorganic fuel is a metal.

25. An automobile air bag system according to claim 19, wherein said oxidizable inorganic fuel is a transition metal.

26. An automobile air bag system according to claim 19, wherein said oxidizable inorganic fuel is selected from the group consisting of boron, silicon and tin.

27. An automobile air bag system according to claim 19, wherein said oxidizable inorganic fuel is selected from the group consisting of aluminum and magnesium.

28. An automobile air bag system according to claim 19, wherein said oxidizable inorganic fuel is an intermetallic compound or alloy of two or more elements selected from among Groups 2, 4, 5, 12, 13, 14 and 15 of the Periodic Table.

29. An automobile air bag system according to claim 19, wherein said oxidizable inorganic fuel is a transition metal hydride.

30. An automobile air bag system according to claim 19, wherein the oxidizing agent is a basic metal carbonate selected from metal carbonate hydroxides, metal carbonate oxides, and hydrates and mixtures thereof.

31. An automobile air bag system according to claim 19, wherein the oxidizing agent is a basic metal carbonate selected from the group of consisting of $CuCO_3.Cu(OH)_2$, $2Co(CO_3).3Co(OH)_2.H_2O$, $Co_{0.69}Fe_{0.34}(CO_3)_{0.2}(OH)_2$, $Na_3[Co(CO_3)_3].3H_2O$, $Zn_2(CO_3)(OH)_2$, $Bi_2Mg(CO_3)_2(OH)_4$, $Fe(CO_3)_{0.12}(OH)_{2.76}$, $Cu_{1.54}Zn_{0.46}CO_3(OH)_2$, $Co_{0.49}Cu_{0.51}(CO_3)_{0.43}(OH)_{1.1}$, $Ti_3Bi_4(CO_3)_2(OH)_2O_9(H_2O)_2$, and $(BiO)_2CO_3$.

32. An automobile air bag system according to claim 19, wherein the oxidizing agent is a basic metal nitrate selected from metal nitrate hydroxides, metal nitrate oxides, and hydrates and mixtures thereof.

33. An automobile air bag system according to claim 19, wherein the oxidizing agent is a basic metal nitrate selected from the group consisting of $Cu_2(OH)_3NO_3$, $Co_2(OH)_3NO_3$, $CuCo(OH)_3NO_3$, $Zn_2(OH)_3NO_3$, $Mn(OH)_2NO_3$, $Fe_4(OH)_{11}NO_3.2H_2O$, $Mo(NO_3)_2O_2$, $BiONO_3.H_2O$, and $Ce(OH)(NO_3)_3.3H_2O$.

34. An automobile air bag system having a hybrid gas-generating system comprising:

a collapsed, inflatable air bag;

a pressure tank having a rupturable opening, said pressure tank containing an inert gas;

a gas-generating device for producing hot combustion gases and capable of rupturing the rupturable opening, said gas-generating device being configured in relation to the pressure tank such that hot combustion gases are mixed with and heat the inert gas and wherein said gas-generating device and the pressure tank are connected to the inflatable air bag such that the combustion gases and inert gas are capable of inflating the air bag, said gas-generating device containing a gas-generating composition comprising an oxidizable inorganic fuel and at least one oxidizing agent selected from the group consisting of a basic metal carbonate and a basic metal nitrate, said oxidizable inorganic fuel and said oxidizing agent being selected such that a mixture of water vapor and either carbon dioxide or nitrogen are the major gaseous reaction products generated by said gas generating composition; and means for igniting the gas-generating composition.

35. An automobile air bag system according to claim 34, wherein said inert gas is argon or helium.

36. An automobile air bag system according to claim 34, wherein said gas-generating composition comprises from about 2% to about 50% fuel and from about 50% to about 98% oxidizing agent.

37. An automobile air bag system according to claim 34, wherein said gas-generating composition comprises from about 60% to about 95% oxidizing agent.

38. An automobile air bag system according to claim 34, wherein the oxidizing agent of said gas-generating composition is present in an amount from about 0.5 to about 3 times the stoichiometric amount of oxidizing agent necessary to completely oxidize the fuel present.

39. An automobile air bag system according to claim 34, wherein the oxidizing agent of said gas-generating composition is present in an amount from about 0.8 to about 2 times the stoichiometric amount of oxidizer necessary to completely oxidize the fuel present.

40. An automobile air bag system according to claim 34, wherein said oxidizable inorganic fuel is a metal.

41. An automobile air bag system according to claim 34, wherein said oxidizable inorganic fuel is a transition metal.

42. An automobile air bag system according to claim 34, wherein said oxidizable inorganic fuel is selected from the group consisting of boron, silicon and tin.

43. An automobile air bag system according to claim 34, wherein said oxidizable inorganic fuel is selected from the group consisting of aluminum and magnesium.

44. An automobile air bag system according to claim 34, wherein said oxidizable inorganic fuel is an intermetallic compound or alloy of two or more elements selected from Groups 2, 4, 5, 12, 13, and 14 of the Periodic Table.

45. An automobile air bag system according to claim 34, wherein said oxidizable inorganic fuel is a transition metal hydride.

46. An automobile air bag system according to claim 34, wherein the oxidizing agent is a basic metal carbonate selected from metal carbonate hydroxides, metal carbonate oxides, and hydrates and mixtures thereof.

47. An automobile air bag system according to claim 34, wherein the oxidizing agent is a basic metal carbonate selected from the group of consisting of $CuCO_3.Cu(OH)_2$, $2Co(CO_3).3Co(OH)_2.H_2O$, $Co_{0.69}Fe_{0.34}(CO_3)_{0.2}(OH)_2$, $Na_3[Co(CO_3)_3].3H_2O$, $Zn_2(CO)_3)(OH)_2$, $Bi_2Mg(CO_3)_2(OH)_4$, $Fe(CO_3)_{0.12}(OH)_{2.76}$, $Cu_{1.54}Zn_{0.46}CO_3(OH)_2$, $Co_{0.49}Cu_{0.51}(CO_3)_{0.43}(OH)_{1.1}$, $Ti_3Bi_4(CO_3)_2(OH)_2O_9(H_2O)_2$, and $(BiO)_2CO_3$.

48. An automobile air bag system according to claim 34, wherein the oxidizing agent is a basic metal nitrate selected from metal nitrate hydroxides, metal nitrate oxides, and hydrates and mixtures thereof.

49. An automobile air bag system according to claim 34, wherein the oxidizing agent is a basic metal nitrate selected from the group consisting of $Cu_2(OH)_3NO_3$, $Co_2(OH)_3NO_3$, $CuCo(OH)_3NO_3$, $Zn_2(OH)_3NO_3$, $Mn(OH)_2NO_3$, $Fe_4(OH)_{11}NO_3.2H_2O$, $Mo(NO_3)_2O_2$, $BiONO_3.H_2O$, and $Ce(OH)(NO_3)_3.3H_2O$.

50. A vehicle containing a supplemental restraint system having an air bag system comprising:

a collapsed, inflatable air bag, a gas-generating device connected to said air bag for inflating said air bag, said gas-generating device containing a gas-generating composition comprising an oxidizable inorganic fuel and at least one oxidizing agent selected from the group consisting of a basic metal carbonate and a basic metal nitrate, said oxidizable inorganic fuel and said oxidizing agent being selected such that a mixture of water vapor and either carbon dioxide or nitrogen are the major gaseous reaction products generated by said gas generating composition; and means for igniting said gas-generating composition.

51. A vehicle as defined in claim 50, further comprising a pressure tank having a rupturable opening, said pressure tank containing an inert gas; wherein the gas-generating device produces hot combustion gases capable of rupturing the rupturable opening, and wherein the gas-generating device is configured in relation to the pressure tank such that hot combustion gases are mixed with and heat the inert gas and wherein the gas-generating device and the pressure tank are connected to the inflatable air bag such that the mixture of combustion gases and inert gas are capable of inflating the air bag.

* * * * *